United States Patent [19]

Mackel

[11] Patent Number: 4,718,886

[45] Date of Patent: Jan. 12, 1988

[54] CONTINUOUS-OPERATION CENTRIFUGE BOWL FOR CONCENTRATING SUSPENDED SOLIDS

[75] Inventor: Wilfried Mackel, Oelde, Fed. Rep. of Germany

[73] Assignee: Westfalia Separator AG, Oelde, Fed. Rep. of Germany

[21] Appl. No.: 10,036

[22] Filed: Feb. 2, 1987

[30] Foreign Application Priority Data

Feb. 5, 1986 [DE] Fed. Rep. of Germany ..... 3603385

[51] Int. Cl.[4] ..... B04B 11/08

[52] U.S. Cl. ..... 494/58; 494/27

[58] Field of Search ..... 494/56, 57, 58, 59, 494/27, 29, 30, 3; 210/781, 782, 360.1

[56] References Cited

U.S. PATENT DOCUMENTS

| | | | |
|---|---|---|---|
| 2,261,394 | 11/1941 | Lindgren | 494/59 |
| 3,167,509 | 1/1965 | Steinacker | 494/3 |
| 3,468,475 | 9/1969 | Thylefors | 494/56 |
| 3,563,453 | 2/1971 | Kompert | 494/3 |
| 3,750,940 | 8/1973 | Nilsson | 494/3 |

*Primary Examiner*—Robert W. Jenkins

*Attorney, Agent, or Firm*—Sprung Horn Kramer & Woods

[57] ABSTRACT

A continuous-operation centrifuge bowl for concentrating suspended solids. The separated solids are conveyed through channels provided with nozzle-like orifices from the periphery of the bowl to a skimming chamber located in the diameter of an incomplete circle that is shorter than the outside diameter of the bowl. The concentrate is diverted out under pressure by means of a skimmer. Each channel communicates through a communicating channel with a distribution chamber, into which some of the diverted-out solids are returned. To create a centrifuge bowl in which the concentrate that is to be recirculated never leaves the vicinity of the bowl, there is another skimmer in the skimming chamber that returns some of the concentrate conveyed into the skimming chamber directly back into the distribution chamber.

8 Claims, 1 Drawing Figure

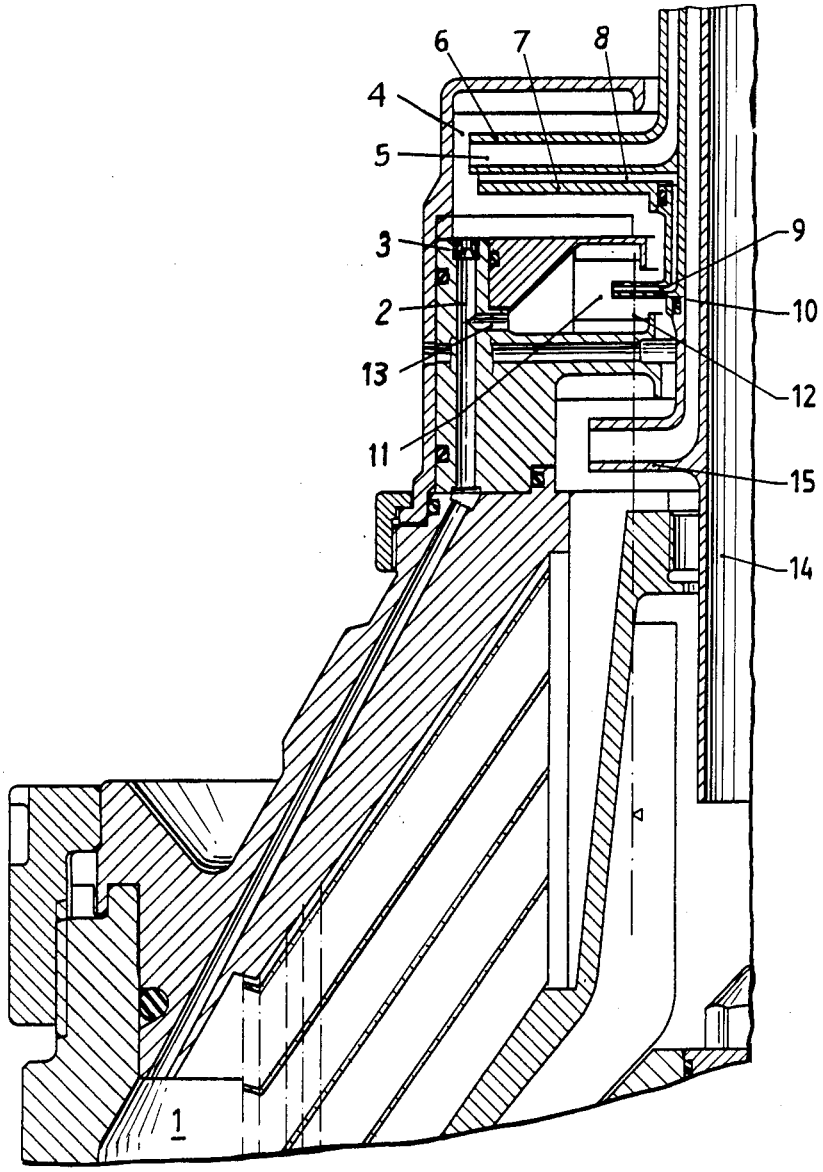
6
7
8
4
5
3
9
2
10
13
12
11
15
14
1

CONTINUOUS-OPERATION CENTRIFUGE BOWL FOR CONCENTRATING SUSPENDED SOLIDS

BACKGROUND OF THE INVENTION

The present invention relates to a continuous operation centrifuge bowl for concentrating suspended solids, wherein the separated solids are conveyed through channels provided with nozzle-like orifices from the periphery of the bowl to a skimming chamber located in the diameter of an incomplete circle that is shorter than the outside diameter of the bowl, with the concentrate diverted out under pressure by means of a skimmer, whereby each channel communicates through a communicating channel with a distribution chamber, into which some of the diverted-out solids are returned.

A centrifuge bowl of this type is known, from German Pat. No. 2 842 967 for instance. The concentrate conveyed into the skimming chamber is diverted out of the bowl by a skimmer and separated outside the bowl, with some being returned to the bowl. The cost of constructing a concentrate-recirculation system of this type is considerable.

SUMMARY OF THE INVENTION

The object of the present invention is to create a centrifuge bowl of the aforesaid type in which the concentrate that is to be recirculated never leaves the vicinity of the bowl.

This object is attained in accordance with the invention by an improvement with another skimmer in the skimming chamber that returns some of the concentrate conveyed into the skimming chamber directly back into the distribution chamber.

To prevent spills in the vicinity of the distribution chamber, the second skimmer can in a practical way have at least one skimming channel with its outlet positioned in a disk that extends below the level of concentrate in the distribution chamber.

The skimming channel in the second skimmer in one preferred embodiment generates, at an equal flow rate, an essentially higher pressure decrease, due to the friction of the liquid, than the skimming channel in the first skimmer.

The skimming channels in the known skimmers are designed in relation to length and cross-section such that the pressure decrease due to friction on the liquid is as low as possible even at high solids concentrations and is negligibly low in relation to hydrostatic pressure loss. Increasing the viscosity of the medium being diverted out accordingly has no significant effect on volumetric flow. This phenomenon is highly desirable for previously known skimmer applications.

It is, however, of advantage for the skimming channel in the second skimmer for the pressure decrease induced by the friction of the liquid against the wall of the skimming channel to be as high as possible to reduce the volume of concentrate flowing through the second skimmer as viscosity increases. The result is less concentrate returning to the distribution chamber and more concentrate withdrawn from the periphery of the bowl. This will decrease the viscosity of the concentrate again, and the volume of concentrate returned will increase again. This action on the part of the recirculating system in accordance with the invention will result in automatic regulation of the volume of recirculated concentrate as a function of its viscosity without outside intervention.

There are in fact several different embodiments of the skimming channel in the second skimmer that will lead to a higher pressure decrease due to friction on the liquid.

The skimming channel in the second skimmer can be much shallower than it is wide. The skimming channel in the second skimmer can be essentially longer than the skimming channel in the first skimmer.

At least one section of the skimming channel 8 in the second skimmer can be a spiral and/or a helix.

The diameter of the second skimmer can be shorter than that of the first skimmer.

BRIEF DESCRIPTION OF THE DRAWING

A preferred embodiment of the invention will now be specified with reference to the attached drawing wherein a cross-section of a section of the centrifuge bowl according to the invention is shown.

DETAILED DESCRIPTION OF THE PREFERRED EMBODIMENTS

The channels 2 that lead from the periphery of a centrifuge bowl 1 are provided with nozzle-like orifices 3 that lead into a skimming chamber 4. Skimming chamber 4 contains a skimmer 6 with a skimming channel 5. Below skimmer 6 is another skimmer 7 that contains a skimming channel 8. The outlet 9 of skimming channel 8 opens into a disk 10. Disk 10 extends radially below the level 12 of concentrate in a distribution chamber 11. Communicating channels 13 extend from distribution chamber 11 to channels 2. To increase the friction of the liquid against its walls, skimming channel 8 can be extremely shallow and can be shaped horizontally like a spiral and vertically like a helix.

The centrifugate is supplied to bowl 1 through an intake 14. The clarified phase is diverted out of the bowl through a third skimmer 15, with the separated solids arriving in skimming chamber 4 through channels 2 and orifices 3. Most of the solids are diverted out of skimming chamber 4 by means of first skimmer 6. A smaller portion of the solid concentrate is returned to distribution chamber 11 through second skimmer 7 and arrives back in channels 2 through communicating channels 13.

As the viscosity of the solid concentrate increases, the volume of solids recirculated solids decreases due to the increased friction of the liquid in skimming channel 8, so that more solid concentrate is withdrawn from the periphery of bowl 1. This in turn decreases the viscosity again. Since the diameter of second skimmer 7 is smaller than that of first skimmer 6, the concentrate is not returned through second skimmer 7 until the level of liquid in skimming chamber 4 is displaced inward to the diameter of second skimmer 7 by constricting an outlet line that communicates with first skimmer 6. The recirculation of the solid concentrate can accordingly be initiated or discontinued as desired.

The basic situation of the recirculated volume of solids can similarly be regulated by further inward displacement of the level of liquid, increasing the pressure of the liquid on the skimming channel 8 in second skimmer 7 and hence the throughput through skimming channel 8.

It will be appreciated that the instant specification and claims are set forth by way of illustration and not limitation, and that various modifications and changes may be made without departing from the spirit and scope of the present invention.

What is claimed is:

1. In a continuous-operation centrifuge bowl for concentrating suspended solids, including channels having nozzle-like orifices for conveying separated solids from the periphery of the bowl to a skimming chamber disposed radially inwardly relative to the outside diameter of the bowl, a first skimmer in the skimming chamber having a skimming channel for diverting with the concentrate out under pressure, and wherein each channel communicates through a communicating channel with a distribution chamber, the improvement comprising: a second skimmer in the skimming chamber for returning a portion of the concentrate conveyed into the skimming chamber directly back into the distribution chamber.

2. The centrifuge bowl as in claim 1, wherein the second skimmer has at least one skimming channel with an outlet positioned in a disk that extends radially outwardly into concentrate in the distribution chamber.

3. The centrifuge bowl as in claim 2, wherein the skimming channel in the second skimmer is configured to have, at an equal flow rate, an essentially higher pressure decrease, due to the friction of the liquid, than the skimming channel in the first skimmer.

4. The centrifuge bowl as in claim 3, wherein the skimming channel in the second skimmer is much shallower than it is wide.

5. The centrifuge bowl as in claim 3, wherein the skimming channel in the second skimmer is longer than the skimming channel in the first skimmer.

6. The centrifuge bowl as in claim 5, wherein at least one section of the skimming channel in the second skimmer is a spiral.

7. The centrifuge bowl as in claim 5, wherein at least one section of the skimming channel in the second skimmer is a helix.

8. The centrifuge bowl as in claim 3, wherein the diameter of the second skimmer is smaller than that of the first skimmer.

* * * * *